US006960762B2

(12) United States Patent
Kawato et al.

(10) Patent No.: US 6,960,762 B2
(45) Date of Patent: Nov. 1, 2005

(54) MASS SPECTROSCOPE AND METHOD FOR ANALYSIS

(75) Inventors: Eizo Kawato, Kyoto-fu (JP); Shinichi Yamaguchi, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 12 days.

(21) Appl. No.: 10/691,661

(22) Filed: Oct. 24, 2003

(65) Prior Publication Data

US 2004/0089799 A1 May 13, 2004

(30) Foreign Application Priority Data

Nov. 6, 2002 (JP) ..... 2002-321978

(51) Int. Cl.[7] ..... H01J 49/42
(52) U.S. Cl. ..... 250/288; 250/282; 250/292
(58) Field of Search ..... 250/288, 282, 250/281, 292

(56) References Cited

U.S. PATENT DOCUMENTS 6,545,268 B1 * 4/2003 Verentchikov et al. ..... 250/281

* cited by examiner

*Primary Examiner*—Jack I. Berman
(74) *Attorney, Agent, or Firm*—Manabu Kanesaka

(57) ABSTRACT

A mass spectroscope includes an ion source for generating ions, a mass spectrometry portion, and an ion retention portion arranged between the ion source and mass spectrometry portion for storing, cooling and/or dissociating the ions before the ions are discharged into the mass spectrometry portion. The mass spectroscope further includes a flow adjusting device for adjusting a gas flowing into the ion retention portion from an outside, and a control device for controlling the flow adjusting device in order to appropriately set a gas pressure in the ion retention portion according to an operation mode such as an introducing operation, a retention operation, and a discharging operation.

8 Claims, 3 Drawing Sheets

MASS SPECTROSCOPE AND METHOD FOR ANALYSIS

BACKGROUND OF THE INVENTION AND RELATED ART STATEMENT

The present invention relates to a mass spectroscope and a method for analyzing ions. More particularly, the present invention relates to a mass spectroscope having an ion retention portion between an ion source and a mass spectrometry portion for storing, cooling ions and for dissociating ions, and a method for analyzing the ions with such a mass spectroscope.

A conventional mass spectroscope has a configuration in which an ion source generates ions, and the ions are introduced to a mass spectrometer such as a quadrupole mass filter or time-of-flight mass spectrometer, so that the ions are separated according to each mass number (mass/charge) and detected. Recently, a mass spectroscope has been developed in which an ion trap, as an ion retention portion, is provided between an ion source and a mass spectrometer. The ion retention portion accumulates and stores various types of ions generated from the ion source. Then, the ions are accordingly sorted, or released from the ion retention portion, and are introduced to the mass spectrometer. The ion trap may have a function of sorting ions according to the mass number. Therefore, a mass spectrometer at a later stage may be used only as a detector, and the ion trap separates ions according to the mass number and directly introduces the ions to the detector.

In the ion trap, a voltage is applied to multiple electrodes constituting the ion trap to form a quadrupole electric field for trapping ions and storing the ions in an ion trapping space. In a mass spectroscope with such an ion trap, it is difficult to obtain sufficient trapping efficiency only with the electric field. Therefore, a gas called a cooling gas may be introduced into the ion trap so that the ions collide with gas molecules. Accordingly, the ions change a direction of motion thereof and converge their trajectories toward the center of the ion trap (for example, refer to Japanese Patent Publication No. 09-189681). This is called a cooling operation because a kinetic energy of the ion is reduced by collisions.

In a case that the ions are dissociated for analyzing fragment ions while the ions are stored in the ion trap, a gas is introduced into the ion trap for inducing collision-induced dissociation, so that the ions collide with the gas molecules and dissociate into fragment ions.

Japanese Patent Publication No. 2002-184349 has disclosed a mass spectroscope in which an additional ion retention portion in front of an ion trap is provided. In the mass spectroscope, a cooling gas is supplied in the ion retention portion before ions are introduced into an ion trap, so that the ions are efficiently introduced into the ion trap. In this case, the cooling gas molecules colliding with the ions absorb ions' kinetic energy as described above.

In the mass spectroscope described above, the cooling gas or the dissociation gas is introduced to the ion retention portion, so that the ions collide with the gas molecules to control the trajectories thereof or enhance efficiency of dissociation of the ions. In this case, when a mass spectrum is obtained through scanning the mass number, the mass spectrum does not have good peak separation.

In view of the problem, the present invention has been made, and an objective of the present invention is to provide a mass spectroscope in which a cooling gas or dissociation gas is introduced in a controlled manner. With the mass spectroscope, it is possible to obtain excellent peak separation when the ion mass is scanned, so that an analysis can be performed with a high mass resolution.

Further objects and advantages of the invention will be apparent from the following description of the invention.

SUMMARY OF INVENTION

In order to attain the objects described above, according to the present invention, a mass spectroscope includes an ion source for generating ions, a mass spectrometry portion, and an ion retention portion arranged between the ion source and mass spectrometry portion for storing and cooling the ions, and/or for dissociating the ions before the ions are discharged into the mass spectrometry portion. The mass spectroscope further includes flow adjusting means for adjusting a gas flowing into the ion retention portion from an outside; and control means for controlling the flow adjusting means in order to appropriately set a gas pressure in the ion retention portion according to an operation mode such as an introducing operation, a retention operation, and a discharging operation.

In the present invention, the ion retention portion may be an ion trap, in which a quadrupole electric field is formed for trapping the ions when a voltage is applied to multiple electrodes. The ion retention portion is not limited to the types described above. The mass spectrometry portion includes at least a detector where the ions reach in a separated state according to mass numbers thereof. The mass spectrometry portion does not necessarily have a function of separating ions according to their mass numbers. The flow adjusting means adjusts the gas flow at a high speed so that the time for changing the flow rate is much shorter than a period of each operation such as the introducing operation, retention operation, and discharging operation. A pulse valve can be used for the flow adjusting means.

In the present invention, the ions are temporarily retained inside the ion retention portion, and then introduced to the mass spectrometry portion. During these processes, the control means controls the flow adjusting means to block or limits the gas flow at a relatively small level when the ions are introduced to the ion retention portion and discharged from the ion retention portion. Further, the control means controls the flow adjusting means to increase the gas flow, so that the gas pressure inside the ion retention portion is increased during at least a part of the period when the ions are stored in the ion retention portion.

According to the present invention, a method for analyzing an ion includes the steps of: generating the ion in an ion source, supplying a gas into an ion retention portion to have a first inner pressure, introducing the ion from the ion source into the ion retention portion, adjusting a flow of the gas so that the ion retention portion has a second inner pressure, adjusting the flow of the gas so that the ion retention portion has a third inner pressure, and discharging the ion from the ion retention portion to a mass spectrometry portion for analyzing the ion. In the invention, the second inner pressure is adjusted to be higher than the first and third inner pressure.

When the ions are introduced into the ion retention portion, if the gas pressure inside the ion retention portion is low, an introduction of the ions into the ion retention portion becomes much effective because fragment collision with gas molecules becomes scarce. Therefore, it is possible to effectively introduce the ions into the ion retention portion. Besides, when the ions are discharged from the ion retention portion, if the gas pressure inside the ion retention portion is low, it is easy to discharge the ions from the ion retention portion due to less collisions with gas molecules. Also, it is easy to reliably impart a predetermined initial energy to each ion, thereby making it easy to align a direction of discharging the ions. Therefore, the ions can be effectively discharged to the mass spectrometry portion, and the ions can be effectively separated in the mass spectrometry portion.

As described above, in the mass spectroscope of the present invention, when a mass spectrum is obtained through the mass scanning, it is possible to effectively separate mass peaks, thereby improving the resolution. Also, it is possible to increase the number of the ions reaching the detector, thereby improving the sensitivity.

DETAILED DESCRIPTION OF PREFERRED EMBODIMENTS

Figure 1:
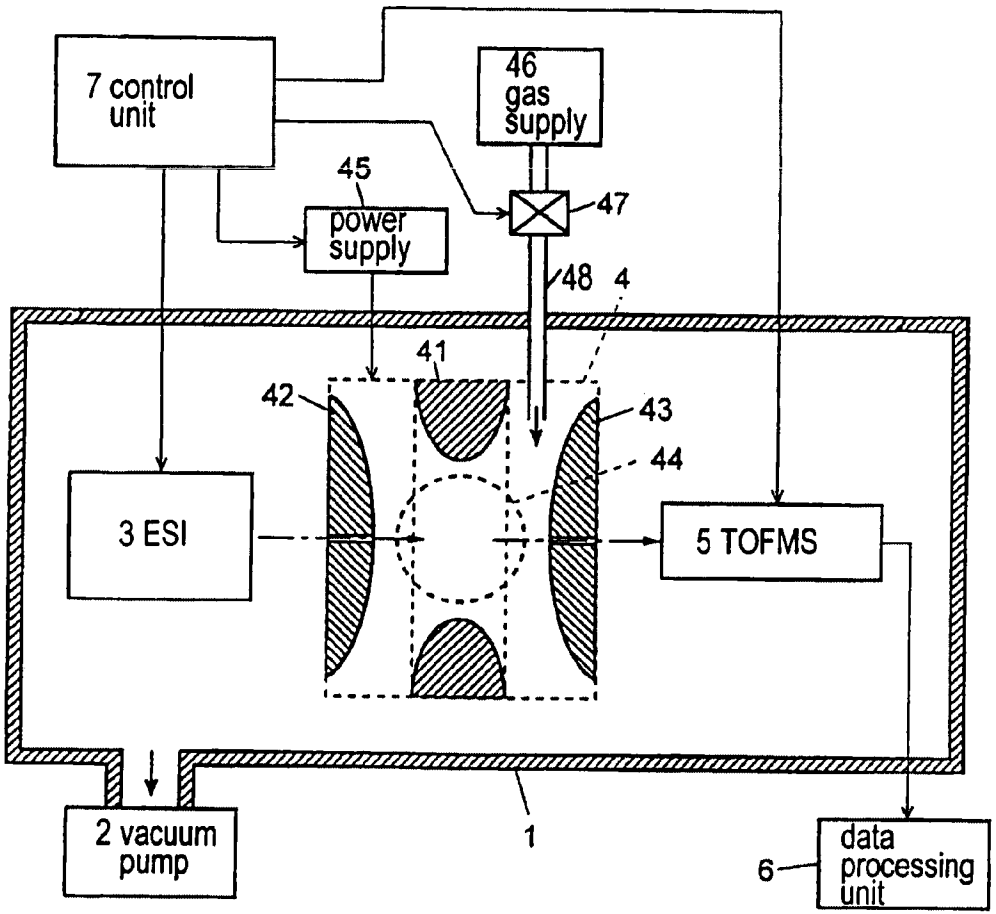
FIG. 1 is a view showing an essential structure of a mass spectroscope with respect to an embodiment of the present invention.

Hereunder, embodiments of the present invention will be explained with reference to the accompanying drawings. FIG. 1 is a view showing an essential structure of a mass spectroscope according to the present embodiment.

The mass spectroscope is an ion-trap type, and includes a vacuum chamber 1 and a vacuum pump 2 for evacuating the vacuum chamber 1. An ESI (Electro Spray Ionization) ion source 3 for generating ions, an ion trap 4 as an ion retention portion, and a mass spectrometer 5 (TOFMS; Time Of Flight Mass Spectrometer) as a mass spectrometry portion are disposed inside the vacuum chamber 1. As shown in FIG. 1, the ESI ion source 3, ion trap 4, and TOFMS 5 are arranged in the same vacuum chamber 1, and may be arranged in different vacuum chambers separated by dividing walls with small holes having a size that each ion can pass through. The ion source and mass spectrometer are not limited to the types described above.

The ion trap 4 includes a ring electrode 41 and two opposing end cap electrodes 42 and 43. A power supply 45 is provided for applying a high frequency and high voltage to the ring electrode 41. A quadrupole electric field is formed at a space surrounded by the ring electrode 41 and the end cap electrodes 42 and 43 to provide an ion trapping space 44 for storing the ions. The power supply 45 applies an auxiliary voltage on the end cap electrodes 42 and 43 according to an analytical mode.

A gas feed-through 48 is connected to the ion trap 4 for introducing a cooling gas from a gas supply 46. A pulse valve 47 is disposed in the gas feed-through 48 for opening and closing the gas feed-through 48. A gas such as Helium (He), Argon (Ar), and Nitrogen ($N_2$) is usually used as the cooling gas. The cooling gas is stable so that the gas is not ionized or dissociated when an ion collides with a gas molecule.

A control unit 7 having a computer as a main component controls the ESI ion source 3, the TOFMS 5, the power supply 45, and the pulse valve 47. A data processing unit 6 receives a detected signal from the TOFMS 5. The data processing unit 6 performs a predetermined processing operation to obtain a mass spectrum, and also performs various processing operations such as qualitative analysis and quantitative analysis if necessary.

An operation of the mass spectroscope will be explained next. The ESI ion source 3 sprays charged liquid droplet from a nozzle to generate the ions. The generated ions are introduced into the ion trap 4 and temporarily trapped in the ion trapping space 44. When the ions are introduced into the ion trap 4, a voltage is applied to the end cap electrodes 42 and 43 so that the ions lose kinetic energy thereof. After all the ions are trapped in the ion trapping space 44, the ions are discharged and introduced into the TOFMS 5. The ions are separated according to the mass numbers thereof and detected with a detector. The detected signal is sent to the data processing unit 6 to obtain the mass spectrum, in which an abscissa represents the mass number and an ordinate represents signal intensity.

The ions move into the ion trap 4 from the ESI ion source 3 with a high level of kinetic energy. Therefore, it is difficult to effectively trap all the ions only with the quadrupole electric field formed by the electrodes 41, 42 and 43. As a result, a large number of the ions collide with the end cap electrode 43 or directly move out from opening of the electrodes. For this reason, the cooling gas is introduced to decrease the kinetic energy of the ions moving into the ion trap 4 so that the electric field easily traps the ions.

When the cooling gas is introduced through the gas feed-through 48, and is filled in the ion trap 4 with an appropriate pressure, the ions entered into the ion trap 4 collide with the gas molecules to lose their kinetic energy, so that ion trajectories are converged toward the center of the ion trap properly. As a result, it is possible to efficiently store the ions in the ion trapping space 44. It is preferred to supply the cooling gas to the ion trap 4 with a predetermined flow rate so that an internal gas pressure of the ion trap 4 is maintained at, for example, approximately $6.0\times10^{-3}$ [Pa ] during at least a part of a retention operation in which the ions are stored in the ion trap 4.

On the other hand, it is preferred that the ions do not collide with the gas molecules during an introducing operation in which the ions are introduced into the ion trap 4 and a discharging operation in which the ions are discharged from the ion trap 4 to the TOFMS 5. If the gas pressure inside the ion trap 4 is too high when the ions are introduced, the ions collide with the gas molecules on entering the ion trap 4, thereby changing their paths and decreasing efficiency of introducing the ions into the ion trap 4. If the gas pressure inside the ion trap 4 is too high when the ions are discharged from the ion trap 4, the ions that are trying to move out from the ion trap 4 collide with the gas molecules, thereby changing their paths and the initial energy of the ions departing from the ion trap 4. Thus, discharging efficiency of the ions into the TOFMS 5 is decreased and the direction of discharged ions is scattered, and further, the characteristic at the mass separation of the ions is adversely affected.

Figure 2:
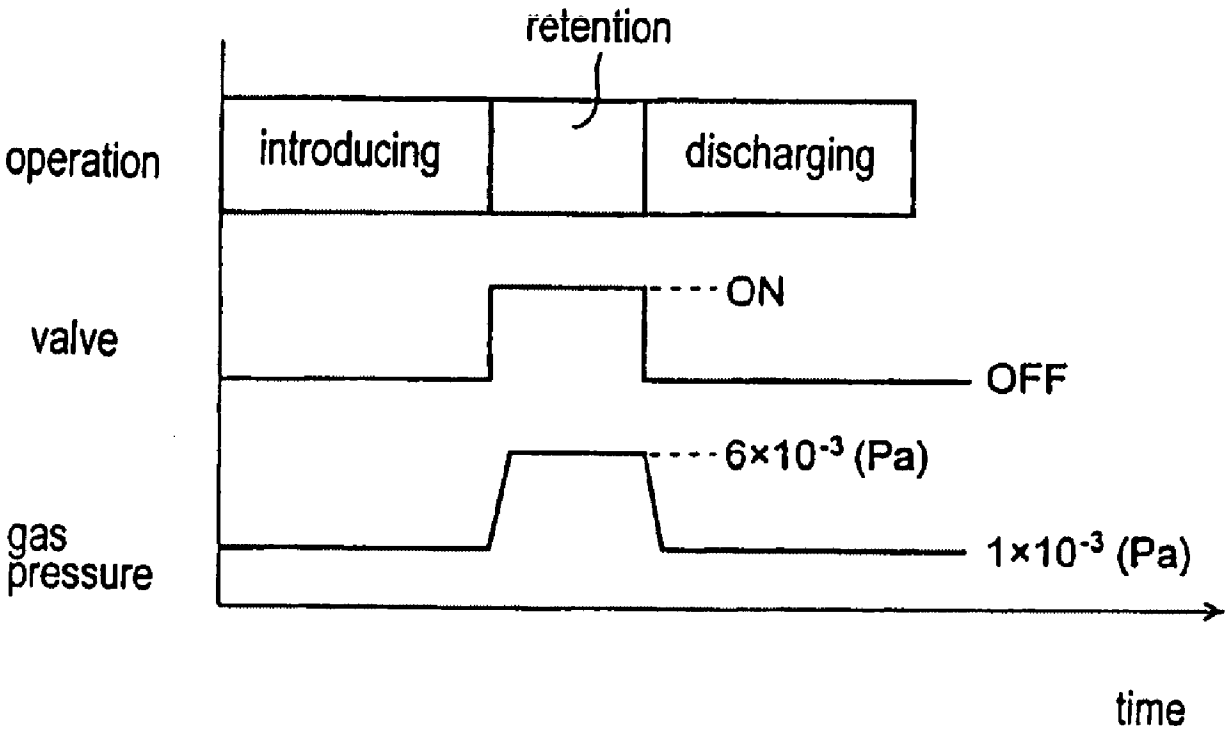
FIG. 2 is a chart for explaining a control operation with respect to the mass spectroscope of the embodiment of the present invention.

In the present embodiment, the control unit 7 controls the pulse valve 47 according to each of the operations of the mass spectrometry as follows. FIG. 2 is a chart for explaining the control operation. The control unit 7 controls the ESI ion source 3, the power supply 45, and the TOFMS 5 in a series of the introducing operation, retention operation, and discharging operation. The control unit 7 turns off or closes the pulse valve 47 in the introducing and discharging operations, and turns on or opens the pulse valve 47 in the retention operation. The retention operation normally takes 10 msec to 100 msec, and the pulse valve 47 can be operated at a far higher speed.

Accordingly, when the pulse valve 47 is turned on, the cooling gas flows into the ion trap 4 at a certain flow rate balancing with an evacuating speed of the vacuum pump 2, so that the gas pressure inside the inner ion trap 4 is maintained at about $6\times10^{-3}$ [Pa]. When the pulse valve 47 is turned off, a leak flow rate of the pulse valve 47 balances with the discharge rate of the vacuum pump 2, so that the gas pressure inside the inner ion trap 4 is maintained at about $1\times10^{-3}$ [Pa].

With the control operation described above, the ion trap 4 is maintained at a higher inner gas pressure to converge the ion trajectory in the retention operation, so that the ions are reliably stored in the ion trapping space 44. On the other hand, in the introducing operation, the ion trap 4 has a lower inner gas pressure and the density of gas molecules is low, so that the ions are efficiently introduced into the ion trap 4. Also, the ion trap 4 has a lower inner gas pressure in the discharge operation, so that the ions are extracted with adequate initial velocities in proper directions. Therefore, it is possible to efficiently separate the ions, and to obtain the mass spectrum with a finely separated peak of each ion.

Figure 3A:
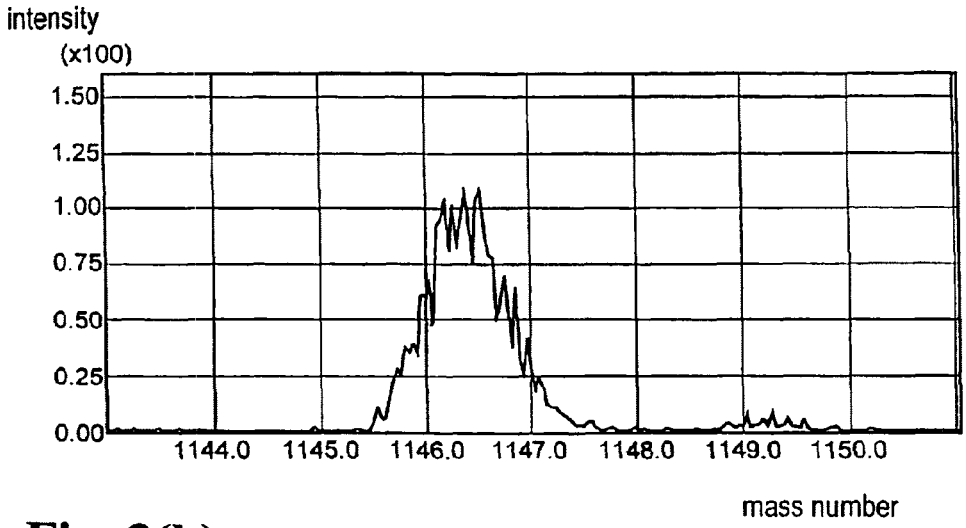
FIGS. 3(*a*) and 3(*b*) are charts of a mass spectrum specifically showing an effect of the control operation with respect to the mass spectroscope of the present embodiment.
Figure 3B:
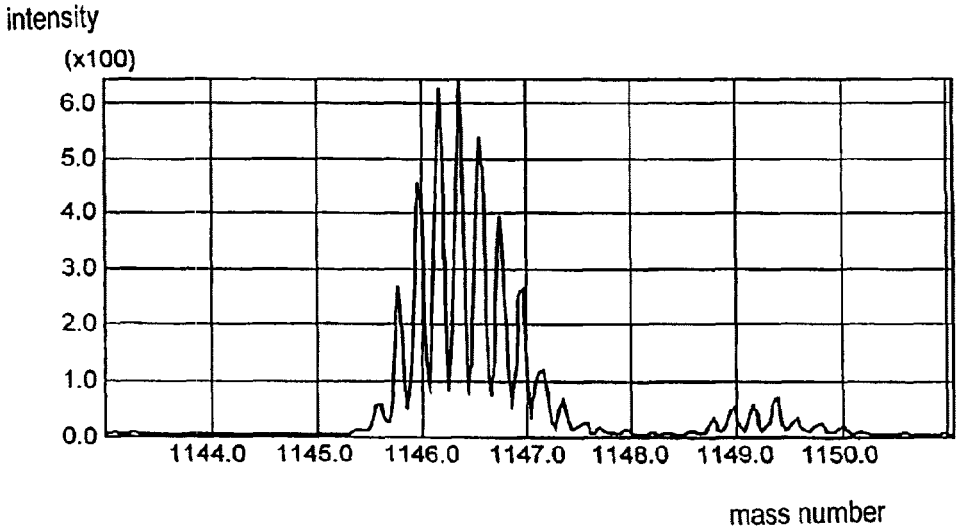

FIGS. 3(*a*) and 3(*b*) are charts of the mass spectra specifically showing an effect of the control operation in the mass spectroscope of the present embodiment. FIG. 3(*a*) is a mass spectrum obtained by a mass spectroscope having a configuration same as that of the present embodiment, and the pulse valve 47 is turned on so that the inner pressure of the ion trap 4 is maintained at about $8\times10^{-3}$ [Pa ] in the introducing operation, retention operation, and discharging operation. FIG. 3(*b*) is a mass spectrum obtained by the mass spectroscope of the present embodiment, and the cooling gas is supplied into the ion trap 4 only during the retention operation as described above.

As shown in FIG. 3(*a*), adjacent peaks are overlapped with each other and the separation of the peaks is not good. On the other hand, peaks shown in FIG. 3(*b*) are finely separated. According to the mass spectroscope of the present embodiment, the mass resolution is greatly improved, and a larger number of the ions are introduced into the TOFMS 5, thereby improving analytical sensitivity.

In the embodiment, the pulse valve 47 is turned on during the retention operation and turned off during the other operations. The present invention is not limited to such a protocol. For example, the pulse valve 47 may be turned on during a part of the retention operation, so that the ion trajectories are converged during the part of the retention operation. Accordingly, it is possible to increase the number of the ions stored in the ion trapping space 44, so that the effect described above is partially achieved. The pulse valve 47 may be turned off during a period partially overlapping with the introducing operation or discharging operation. In this case, it is possible to improve the efficiency of introducing the ions to the ion trap 4 or to properly discharge the ions from the ion trap 4 into the TOFMS 5 at least during a period with no overlap, so that the effect described above is partially achieved.

As described above, the pulse valve 47 can be operated at a high speed to block or flow the cooling gas. It is still possible to cause a certain level of time delay until the inner gas pressure of the ion trap 4 becomes stable. In this case, it is possible to control the operation of the pulse valve 47 with the time delay in consideration.

In the embodiment described above, cooling the ion is carried out inside the ion trap 4. Alternatively, a dissociation gas for inducing collisional dissociation may be introduced into the ion trap 4 instead of the cooling gas. In this case, the ions collide with the gas molecules to enhance dissociation of the ions. The ions, thus, generated by the dissociation are discharged from the ion trap 4 to the TOFMS 5 in the discharge operation to get a mass spectrum of fragment ions.

While the invention has been explained with reference to the specific embodiments of the invention, the explanation is illustrative and the invention is limited only by the appended claims.

What is claimed is:

1. A mass spectroscope comprising:

an ion source for generating ions, a mass spectrometry portion for analyzing the ions, an ion retention portion arranged between the ion source and the mass spectrometry portion for storing, cooling and dissociating the ions, a gas supply connected to the ion retention portion for supplying a gas to the ion retention portion, flow adjusting means disposed between the ion retention portion and the gas supply for adjusting a flow of the gas supplied to the ion retention portion, and control means connected to the flow adjusting means for controlling the flow adjusting means to maintain an inner pressure of the ion retention portion according to operation modes at the ion retention portion, said control means operating the flow adjusting means to introduce the gas into the ion retention portion at a retention operation in which the ions are stored in the ion retention portion so that the inner pressure of the ion retention portion in the retention operation is higher than those in introducing and discharging operations in which the ions are introduced into the ion retention portion and the ions are discharged from the ion retention portion, respectively.

2. A mass spectroscope according to claim 1, wherein said operation modes include the introducing operation in which the ions are introduced from the ion source into the ion retention portion, the retention operation in which the ions are stored, cooled and dissociated in the ion retention portion, and the discharging operation in which the ions are discharged from the ion retention portion to the mass spectrometry portion, said control means controlling the flow adjusting means to introduce the gas only at the retention operation for cooling.

3. A mass spectroscope according to claim 2, wherein said flow adjusting means is a pulse valve for quickly opening and closing gas flow from the gas supply.

4. A method for analyzing ions, comprising:

generating the ions in an ion source, introducing the ions from the ion source into an ion retention portion, increasing a pressure in the ion retention portion by introducing a gas into the ion retention portion only while the ions are retained in the ion retention portion, and discharging the ions from the ion retention portion to a mass spectrometry portion for analyzing the ions after the pressure in the ion retention portion is decreased.

5. A method for analyzing ions according to claim 4, wherein said gas is introduced into the ion retention portion after the ions are introduced into the ion retention portion and before the ions are discharged from the ion retention portion.

6. A method for analyzing ions according to claim 5, wherein said gas is maintained at a pressure about $6\times10^{-3}$ [Pa] in the ion retention portion when the gas is introduced.

7. A method for analyzing ions according to claim 6, further comprising, evacuating the gas in a vacuum chamber containing said ion retention portion so that a flow of the gas substantially balances with an evacuating speed of a vacuum pump in the vacuum chamber.

8. A method for analyzing ions according to claim 7, wherein when the gas is not introduced into the ion retention portion, the pressure in the ion retention portion is maintained at about $1\times10^{-3}$ [Pa].

* * * * *